US008540229B2

(12) United States Patent
Tsuji

(10) Patent No.: US 8,540,229 B2
(45) Date of Patent: Sep. 24, 2013

(54) SHEET PROCESSING APPARATUS AND IMAGE FORMING APPARATUS FOR STABLY ALIGNING SHEETS HAVING A LONG LENGTH

(71) Applicant: Canon Kabushiki Kaisha, Tokyo (JP)

(72) Inventor: Hiroharu Tsuji, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/629,358

(22) Filed: Sep. 27, 2012

(65) Prior Publication Data

US 2013/0082432 A1 Apr. 4, 2013

(30) Foreign Application Priority Data

Sep. 29, 2011 (JP) ..... 2011-214011

(51) Int. Cl.
*B65H 37/04* (2006.01)

(52) U.S. Cl.
USPC ..... 270/58.17; 270/58.16; 270/58.12; 271/222; 271/221; 271/224

(58) Field of Classification Search
USPC ..... 270/58.12, 58.16, 58.17; 271/220, 271/221, 222, 223, 224
See application file for complete search history.

(56) References Cited

U.S. PATENT DOCUMENTS

| | | | | |
|---|---|---|---|---|
| 3,949,982 | A * | 4/1976 | Snellman et al. | 271/222 |
| 4,047,713 | A * | 9/1977 | Snellman et al. | 271/221 |
| 6,659,455 | B2 * | 12/2003 | Endo et al. | 271/220 |
| 6,848,688 | B1 * | 2/2005 | Ruthenberg et al. | 271/221 |
| 6,916,020 | B2 * | 7/2005 | Hasegawa | 271/171 |
| 7,464,930 | B2 * | 12/2008 | Masuda et al. | 271/224 |
| 8,083,227 | B2 * | 12/2011 | Mizubata et al. | 271/221 |
| 8,109,505 | B2 * | 2/2012 | Shih et al. | 271/223 |
| 8,246,034 | B2 * | 8/2012 | Tsuchiya | 270/58.12 |
| 2012/0025442 | A1 * | 2/2012 | Naraoka | 270/58.12 |

FOREIGN PATENT DOCUMENTS

| | | |
|---|---|---|
| JP | 2003-335450 A | 11/2003 |
| JP | 2006-306518 A | 11/2006 |

* cited by examiner

*Primary Examiner* — Patrick Mackey
(74) *Attorney, Agent, or Firm* — Canon USA, Inc., IP Division

(57) ABSTRACT

The alignment unit includes: an upstream-side pressing portion that presses a side edge of the sheet; and a downstream-side pressing portion that presses the side edge of the sheet. The downstream-side pressing portion includes: a first pressing portion that is arranged downstream of the center of gravity of a predetermined-size sheet and upstream of the downstream edge of the predetermined-size sheet and that presses the predetermined-size sheet; and a second pressing portion that is arranged downstream of the downstream edge of the predetermined-size sheet and downstream of the center of gravity of a large-size sheet having twice or more than twice the length of the predetermined-size sheet and that presses the large-size sheet. The second pressing portion is formed to protrude further toward the center side in the width direction than the first pressing portion.

16 Claims, 10 Drawing Sheets

SHEET PROCESSING APPARATUS AND IMAGE FORMING APPARATUS FOR STABLY ALIGNING SHEETS HAVING A LONG LENGTH

BACKGROUND OF THE INVENTION

1. Field of the Invention

The present invention relates to a sheet processing apparatus for processing sheets.

2. Description of Related Art

There are conventional image forming apparatuses such as copying machines including a sheet processing apparatus. For example, after images are formed on sheets, such sheet processing apparatus aligns or binds the sheets.

One such sheet processing apparatus executes an alignment process while supporting a sheet by an intermediate stacking tray and a pair of supporting portions. These supporting portions face each other and are arranged downstream of the intermediate stacking tray in a sheet conveyance direction. In addition, the supporting portions support side edges of the sheet in a width direction perpendicular to the sheet conveyance direction (see Japanese Patent Application Laid-Open No. 2006-306518 and Japanese Patent Application Laid-Open No. 2003-335450). However, according to the conventional techniques, it is difficult to stably align sheets having a long length (particularly, sheets having twice or more than twice the length of predetermined-size sheets) in the sheet conveyance direction perpendicular to the sheet width direction. Therefore, an apparatus capable of suitably aligning large-size sheets is demanded.

SUMMARY OF THE INVENTION

The present invention is directed to a sheet processing apparatus and an image forming apparatus capable of stably aligning sheets having a long length.

In one aspect of the present invention, there is provided a sheet processing apparatus, including: a conveyance portion configured to convey a sheet in a sheet conveyance direction; a sheet stacking portion configured to stack a sheet conveyed by the conveyance portion; a sheet supporting portion arranged downstream of the sheet stacking portion in the sheet conveyance direction and configured to support side edges of the sheet in a width direction perpendicular to the sheet conveyance direction; and an alignment unit arranged on one side of the sheet supporting portion in the width direction and configured to align the position of the sheet supported by the sheet supporting portion in the width direction by moving toward a center side in the width direction. The alignment unit includes: an upstream-side pressing portion configured to press a side edge of the sheet supported by the sheet supporting portion in the width direction; and a downstream-side pressing portion arranged downstream of the upstream-side pressing portion in the sheet conveyance direction and configured to press the side edge of the sheet supported by the sheet supporting portion. The downstream-side pressing portion includes: a first pressing portion arranged downstream of the center of gravity of a predetermined-size sheet supported by the sheet supporting portion in the sheet conveyance direction and upstream of a downstream edge of the predetermined-size sheet in the sheet conveyance direction and configured to press the predetermined-size sheet; and a second pressing portion arranged downstream of the downstream edge of the predetermined-size sheet supported by the sheet supporting portion in the sheet conveyance direction and downstream of the center of gravity of a large-size sheet having twice or more than twice the length of the predetermined-size sheet and configured to press the large-size sheet. The second pressing portion is formed to protrude further toward the center side in the width direction than the first pressing portion.

According to the present invention, predetermined-size sheets and large-size sheets can be stably aligned.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
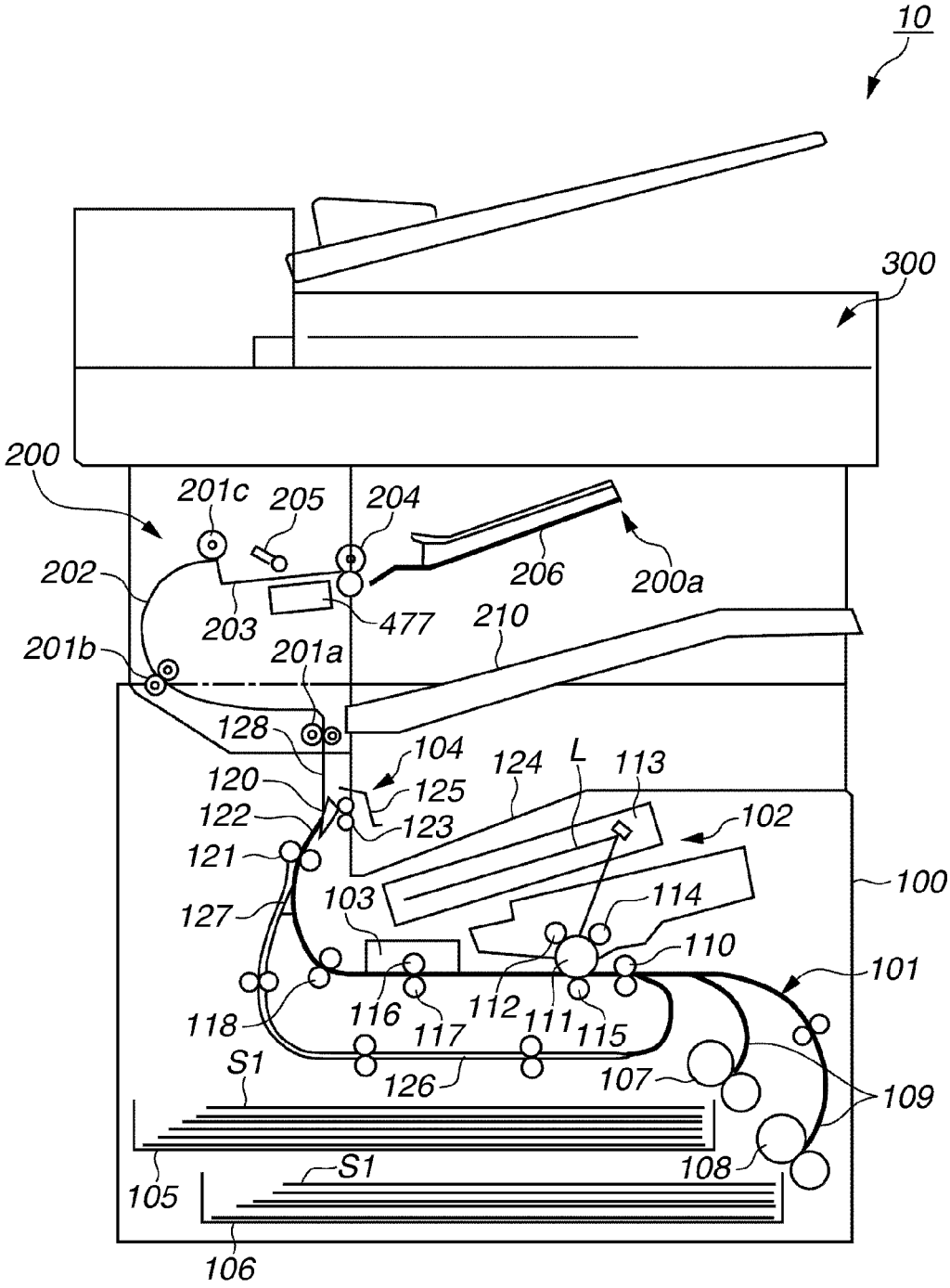
FIG. 1 illustrates a configuration of an image forming apparatus including a sheet processing apparatus according to a first exemplary embodiment of the present invention.

Next, exemplary embodiments of the present invention will be described in detail with reference to the drawings. FIG. 1 illustrates a configuration of an image forming apparatus 10 including a sheet processing apparatus 200 according to a first exemplary embodiment of the present invention. In FIG. 1, the image forming apparatus 10 includes an image forming apparatus body 100 (which will hereinafter be referred to as the apparatus body 100). This apparatus body 100 includes: an image forming unit 102; a sheet feeding unit 101 for feeding a sheet to the image forming unit 102; a fixing unit 103; and a sheet discharging unit 104.

In addition, the sheet processing apparatus 200 is arranged on the top of the apparatus body 100. After the image forming unit 102 forms images on sheets, the sheet processing apparatus 200 executes a process such as a stapling process on selectively-conveyed sheets. In addition, an image reading apparatus 300 reading a document image is arranged on the top of the sheet processing apparatus 200.

The image forming unit 102 includes: a photosensitive drum 111 rotating in an arrow direction (clockwise); an exposure unit 113; a charging roller 112 generally sequentially arranged along the rotation direction of the photosensitive drum 111; a development unit 114; and a transfer roller 115. The image forming unit 102 forms a toner image on a sheet S, by causing these process units to execute an image formation process.

In addition, the sheet feeding unit 101 includes: upper and lower sheet feeding cassettes 105 and 106, respectively, each storing a stack of sheets S on which images are to be formed; upper sheet feeding rollers 107; lower sheet feeding rollers 108; conveyance guides 109; and registration rollers 110. The fixing unit 103 includes: a fixing roller 116; a pressure roller 117 that is in contact with the fixing roller 116 from below; and sheet discharge rollers 118. In addition, the sheet discharging unit 104 includes: a sheet discharge port switch member 120; conveyance rollers 121 capable of rotating clockwise and counterclockwise; a sheet discharge guide 122; sheet discharge rollers 123; a sheet discharge unit 124 arranged on the upper surface of the apparatus body 100; and a full-load detection lever 125.

The position of the sheet discharge port switch member 120 can be switched between a sheet processing position (as illustrated in FIG. 1) for conveying a sheet on which an image has been formed to the sheet processing apparatus 200 and a sheet discharge position for discharging the sheet to the sheet discharge unit 124. In addition, a sheet re-feeding path 126 is arranged among the image forming unit 102, the fixing unit 103, and the upper sheet feeding cassette 105. This sheet re-feeding path 126 is used when the image forming unit 102 executes two-sided printing on a sheet S.

Next, an image forming operation executed by the image forming apparatus 10 having the above configuration will be described. First, when the image forming unit 102 receives image information from a computer (not illustrated) or a network (not illustrated) such as a local area network (LAN) connected to the apparatus body 100 or when the image forming unit 102 receives image information read by the image reading apparatus 300, the exposure unit 113 emits laser light L based on the image information. Next, a surface of the photosensitive drum 111 is exposed to the laser light L, the surface being evenly charged with a predetermined polarity and potential by the charging roller 112.

As a result, charges are removed from the exposed portion on the surface of the photosensitive drum 111, and an electrostatic latent image is formed on the surface of the photosensitive drum 111. Next, the development unit 114 applies toner to this electrostatic latent image to develop the image as a toner image. The toner image formed on the photosensitive drum 111 in this way is conveyed to a transfer nip portion between the photosensitive drum 111 and the transfer roller 115, along with the rotation of the photosensitive drum 111 in the arrow direction.

A sheet S on which an image is to be formed is separately fed from the upper or lower sheet feeding cassette 105 or 106 via the sheet feeding rollers 107 or 108. Next, the sheet S is conveyed to the registration rollers 110 along the corresponding conveyance guide 109. Since the registration rollers 110 are in a stopped state, the sheet S is temporarily stopped by the registration rollers 110. Next, the temporarily-stopped sheet S is supplied to the transfer nip portion by the registration rollers 110, which start to rotate in synchronization with the toner image formed by the image forming unit 102.

Consequently, the toner image on the photosensitive drum 111 is transferred to the sheet S by the transfer roller 115. Next, the sheet S having the toner image that has been transferred from the photosensitive drum 111 is conveyed to the fixing unit 103, where the sheet S is pinched and conveyed by a fixing nip portion formed between the fixing roller 116 and the pressure roller 117. Next, the toner image is fixed on the front side of the sheet S by being heated and pressed. If the sheet S does not need to be further processed, the discharge port switch member 120 is set at the position for conveying the sheet S to the sheet discharge rollers 123. Thus, the sheet S, on which the toner image has been fixed, is conveyed by the conveyance rollers 121 along the discharge guide 122 and is discharged facedown onto the sheet discharge unit 124 by the sheet discharge rollers 123. Namely, the sheet S is discharged, with the side including the toner image laid facedown.

The full-load detection lever 125 is arranged above the sheet discharge unit 124. This full-load detection lever 125 detects whether the sheet discharge unit 124 is fully loaded with discharged sheets S. If the full-load detection lever 125 detects that the sheet discharge unit 124 is fully loaded with discharged sheets S, a control unit (not illustrated) does not allow the apparatus body 100 to execute further image formation until discharged sheets S are removed from the sheet discharge unit 124.

If a mode for two-sided printing is set for the sheet S, after the trailing edge of the sheet S including the toner image fixed on one side (front side) passes through the conveyance rollers 121, a sheet re-feeding path switch member 127 is switched to a sheet re-feeding position. Next, the sheet S is conveyed in the reverse direction and is guided to the paper re-feeding path 126. Next, as the sheet S is conveyed through the image forming unit 102 and the fixing unit 103, an image is formed on the back side of the sheet S.

If a process such as a stapling process is set for the sheet S after image formation or if the sheet S is set to be discharged from the sheet processing apparatus 200 without any process, the discharge port switch member 120 is switched in advance to the sheet processing position for conveying the sheet S to the sheet processing apparatus 200, as illustrated in FIG. 1. In this way, the sheet S is conveyed from the apparatus body 100 to the sheet processing apparatus 200 along a conveyance path 128.

As described above, the sheet processing apparatus 200 executes a process such as a binding process on a sheet S after an image is formed thereon. The sheet processing apparatus 200 includes: conveyance rollers 201*a* to 201*c* conveying a sheet S from the apparatus body 100; an intermediate stacking portion 203 onto which a sheet S conveyed by the conveyance rollers 201*a* to 201*c* is temporarily loaded to execute an alignment process; and a removable discharge roller pair 204 discharging a sheet S.

The sheet S conveyed from the apparatus body 100 is conveyed to the intermediate stacking portion 203 serving as a sheet stacking portion, along a conveyance path 202 by the conveyance rollers 201*a* to 201*c* serving as a conveyance portion for conveying a sheet in the sheet conveyance direction. If a process such as a binding process is not executed on the conveyed sheet S, the discharge roller pair 204 is set in a nip state. Thus, the conveyed sheet S is discharged onto a sheet discharge tray 210, without being temporarily held at the intermediate stacking portion 203. If a binding process is executed on the conveyed sheet S, the discharge roller pair 204 is not in a nip state. Thus, the conveyed sheet S is temporarily held at the intermediate stacking portion 203.

Figure 2:
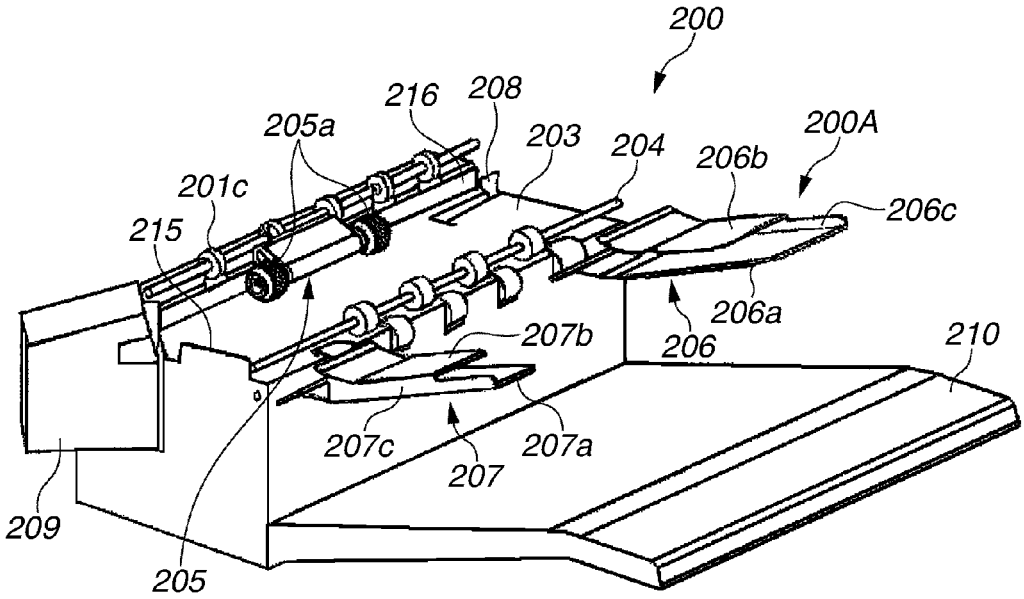
FIG. 2 is a perspective view of the sheet processing apparatus.

As illustrated in FIG. 2, the sheet processing apparatus 200 includes: a conveyance-direction alignment portion 205 aligning the trailing edge, which is the sheet-conveyance-direction upstream edge of the sheet conveyed onto the intermediate stacking portion 203; and a width-direction alignment portion 200A aligning the sheet in the width direction perpendicular to the sheet conveyance direction. In addition, the sheet processing apparatus 200 includes: a stapler 209 serving as a binding portion executing a binding process on an aligned sheet stack; the sheet discharge tray 210 onto which the processed or conveyed sheets are loaded; and a side-edge-alignment reference wall 215 that comes into contact with a side edge of the sheet during a width-direction alignment operation.

The conveyance-direction alignment portion 205 includes: a trailing-edge-alignment reference wall 216 that comes into contact with the trailing edge, which is the upstream edge of a sheet in the sheet conveyance direction, and that serves as an alignment reference for aligning the trailing edge of the sheet; and rubber rollers 205*a* that are friction members, for example. These rubber rollers 205*a* are moved by an actuator (not illustrated) between a retracted position that is above a sheet to be aligned and a contact position where the rubber rollers 205*a* come into contact with a sheet. When the trailing edge of the sheet is aligned, the rubber rollers 205*a* are brought into contact with the top surface of the sheet. Next, the rubber rollers 205*a* are rotated to press the trailing edge of the sheet to the trailing-edge-alignment reference wall 216, which serves as a trailing edge contact portion that is brought into contact with the trailing edge of a sheet, so that the sheet is conveyed in the direction of the trailing-edge-alignment reference wall 216. In this way, an alignment process in the conveyance direction is executed.

The width-direction alignment portion 200A includes a front-side alignment portion 207 serving as a first width-direction alignment portion arranged downstream of the intermediate stacking portion 203; a rear-side alignment portion 206 serving as a second width-direction alignment portion; and an intermediate-stacking-portion side alignment portion 208 arranged at the intermediate stacking portion 203. The rear- and front-side alignment portions 206 and 207 are arranged to face each other downstream of the intermediate stacking portion 203. In addition, these rear- and front-side alignment portions 206 and 207 serving as a pair of alignment portions support both edges of a sheet in the width direction perpendicular to the sheet conveyance direction, including the center of gravity G of the sheet placed on the intermediate stacking portion 203. In addition, these rear- and front-side alignment portions 206 and 207 can be reciprocally moved in the width direction by an actuator (not illustrated), to align the sheet position in the width direction.

The rear-side alignment portion 206 includes: a supporting portion 206*a* serving as a sheet supporting portion for supporting the sheet bottom surface; an upper restriction portion 206*b* for preventing a sheet edge from being raised by curling or the like; and a vertical portion 206*c* connecting the supporting portion 206*a* and the upper restriction portion 206*b*.

In addition, the front-side alignment portion 207 includes: a supporting portion 207*a* serving as a sheet supporting portion for supporting the sheet bottom surface; an upper restriction portion 207*b* for preventing a sheet edge from being raised by curling or the like; and a vertical portion 207*c* connecting the supporting portion 207*a* and the upper restriction portion 207*b*. The rear- and front-side alignment portions 206 and 207 and the intermediate-stacking-portion side alignment portion 208 serve as moving portions and are driven by a drive motor 477 in the width direction.

Figure 3A:
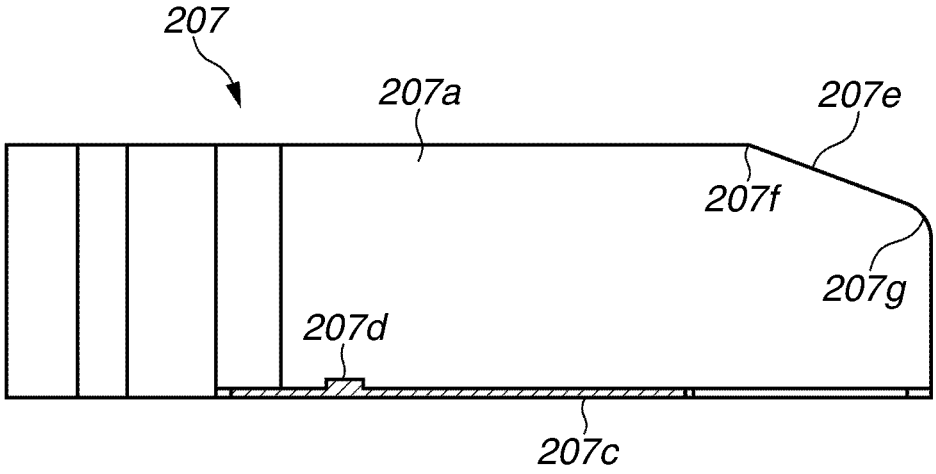
FIGS. 3A and 3B illustrate configurations of front- and rear-side alignment portions of the sheet processing apparatus, respectively.
Figure 3B:
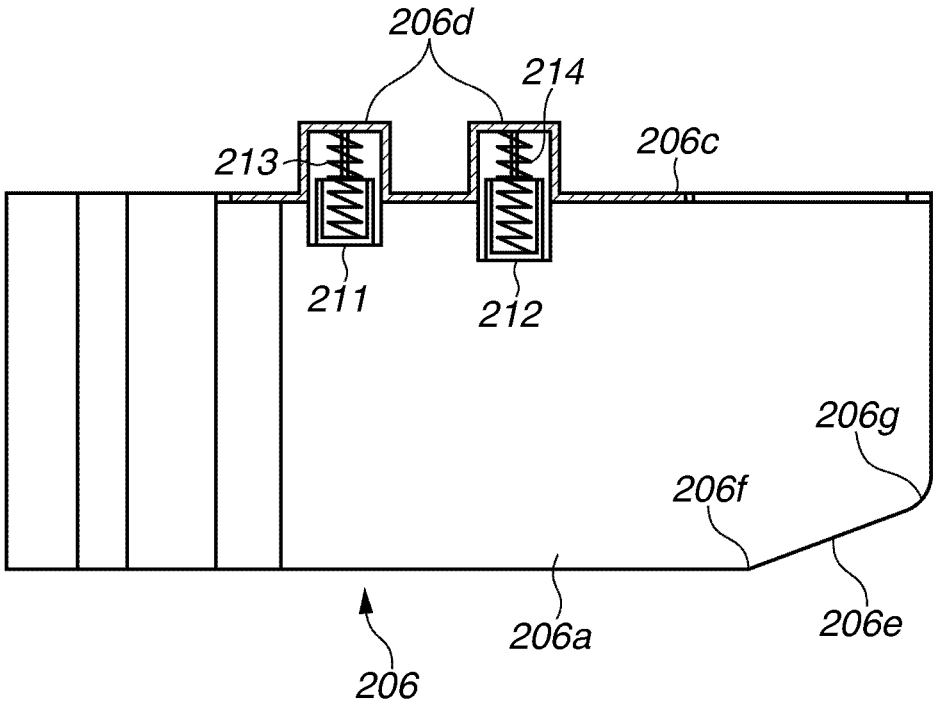

As illustrated in FIG. 3A, an alignment reference wall 207*d* is arranged on the vertical portion 207*c* of the front-side alignment portion 207. The alignment reference wall 207*d* has a protrusion toward the center of the sheet in the width direction. As will be described below, when a sheet is aligned in the width direction, this alignment reference wall 207*d* is brought into contact with a sheet edge and is used as a reference for the alignment. In addition, as illustrated in FIG. 3B, two pressing members 211 and 212 are formed on the vertical portion 206*c* of the rear-side alignment portion 206, which constitutes an alignment unit with the intermediate-stacking-portion side alignment portion 208. The pressing members 211 and 212 protrude toward the center of the sheet in the width direction and can move in the width direction along a guiding portion 206*d* formed on the vertical portion 206*c*.

When the rear-side alignment portion 206 moves in the width direction, these pressing members 211 and 212 constitute a downstream-side pressing portion that presses a side edge in the width direction at a position downstream of the center of gravity G of the sheet in the sheet conveyance direction. In addition, an elastic member 213 is arranged between the pressing member 211 and the guiding portion 206*d*, and an elastic member 214 is arranged between the pressing member 212 and the guiding portion 206*d*. These elastic members 213 and 214 can bring the pressing members 211 and 212 into contact with a side edge of the sheet, by causing the pressing members 211 and 212 to protrude elastically.

Namely, the elastic member 213 is arranged between the pressing member 211 and the vertical portion 206*c*, which serves as a holding portion for movably holding the pressing member 211. Likewise, the elastic member 214 is arranged between the vertical portion 206*c* and the pressing member 212. Each of the pressing members 211 and 212 serving as a downstream-side pressing portion is arranged to protrude further toward the center of the sheet in the width direction than the intermediate-stacking-portion side alignment portion 208 serving as an upstream-side pressing portion.

In addition, as will be described below, even when the pressing members 211 and 212 are pressed by a sheet in the direction opposite to the moving direction, as soon as the pressing force by the sheet is removed, the elastic force of the elastic members 213 and 214 returns the pressing members 211 and 212 to the respective home positions as illustrated in FIG. 3B. In the first exemplary embodiment, the second pressing member 212 arranged downstream in the sheet conveyance direction is formed to protrude slightly further toward the center of the sheet in the width direction than the first pressing member 211 serving as a first pressing portion arranged upstream in the sheet conveyance direction.

In addition, the second pressing member 212 is arranged downstream of the trailing edge of an A4-size sheet (predetermined-size sheet) in the sheet conveyance direction. For example, when the sheet processing apparatus 200 aligns an A4-size sheet in the width direction, the second pressing member 212 does not come into contact with the sheet. However, when the sheet processing apparatus 200 aligns an A3-size sheet, which is larger than the A4-size sheet, the second pressing member 212 comes into contact with the trailing edge of the sheet in the width direction.

The second pressing member 212 is arranged downstream of the center of gravity G of an A3-size sheet (large size sheet) in the sheet conveyance direction. In addition, the supporting portions 206*a* and 207*a* are arranged to support the downstream portion of an A3-size sheet (large size) in the sheet conveyance direction, including the center of gravity G of the sheet. These supporting portions 206*a* and 207*a* are sufficiently long in the sheet conveyance direction, to prevent the supported A3-size sheet from slipping.

In addition, the intermediate-stacking-portion side alignment portion 208 is arranged to be movable in the width direction along a guiding portion (not illustrated) arranged at the intermediate stacking portion 203. The intermediate-stacking-portion side alignment portion 208 can reciprocally be moved by a linking portion 98 in the width direction in synchronization with the rear-side alignment portion 206. In addition, this intermediate-stacking-portion side alignment portion 208, which moves in the width direction in synchronization with the rear-side alignment portion 206, constitutes the upstream-side pressing portion for pressing a side edge that is upstream of the center of gravity G of the sheet in the sheet conveyance direction. An elastic member (not illustrated) is arranged between the alignment portion 208 and the guiding portion (not illustrated).

In this way, as will be described below, even when pressed by a sheet, once the pressing force by the sheet is removed, the elastic force of the elastic member returns the intermediate-stacking-portion side alignment portion 208 to the home position as illustrated in FIG. 2. For example, the synchronization of the intermediate-stacking-portion side alignment portion 208 with the rear-side alignment portion 206 can electronically be achieved by a motor that drives each of the portions 208 and 206.

Figure 4A:
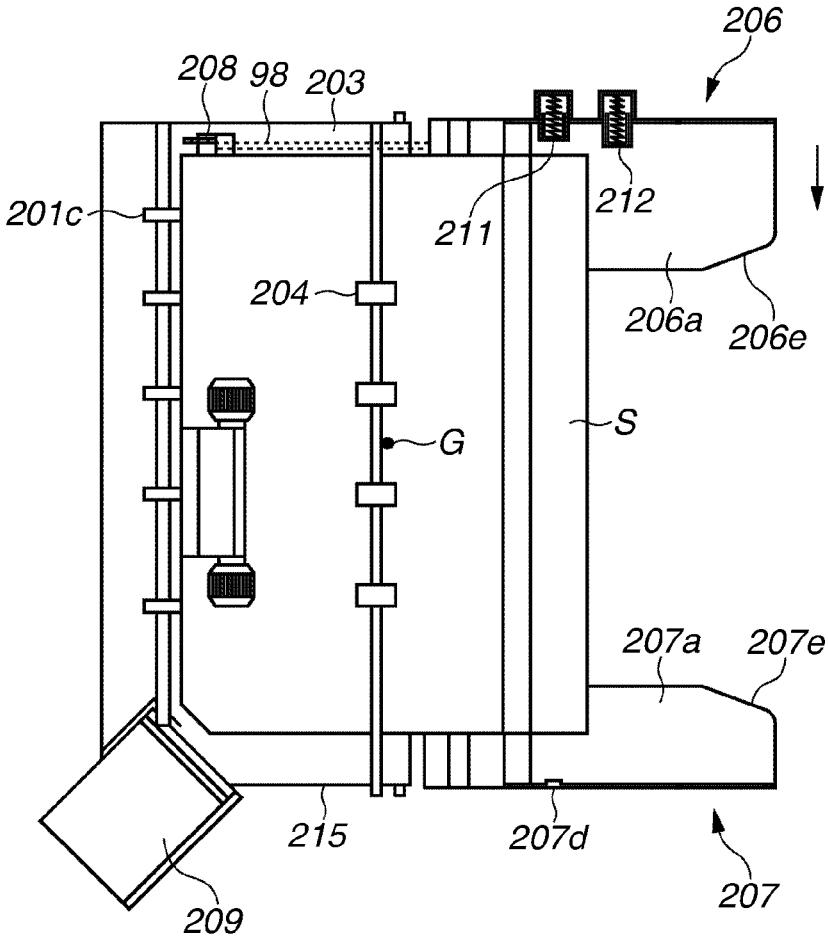
FIGS. 4A and 4B illustrate the sheet processing apparatus that has received an A4-size sheet.

Next, a sheet processing operation of the sheet processing apparatus 200 having the above configuration will be described. FIG. 4A illustrates a positional relationship of various components when the intermediate stacking portion 203 has received an A4-size sheet. In FIG. 4A, to clearly indicate the sheet position, the upper restriction portions 206*b* and 207*b* of the rear- and front-side alignment portions 206 and 207 are not illustrated.

When an A4-size sheet S is conveyed, the front-side alignment portion 207 is moved by the drive motor 477 toward the center of the sheet from a retracted position to reach a supporting position where the supporting portion 207*a* can support the bottom surface of the sheet S. When moved to this supporting position, the alignment reference wall 207*d* of the front-side alignment portion 207 is positioned in the same plane as the side-edge-alignment reference wall 215. Likewise, the rear-side alignment portion 206 is moved by the drive motor 477 to a supporting position where the support portion 206*a* can support the bottom surface of the sheet S and the first pressing member 211 does not hinder conveyance of the sheet S. During this operation, the discharge roller pair 204 is separated from the sheet S.

Figure 4B:
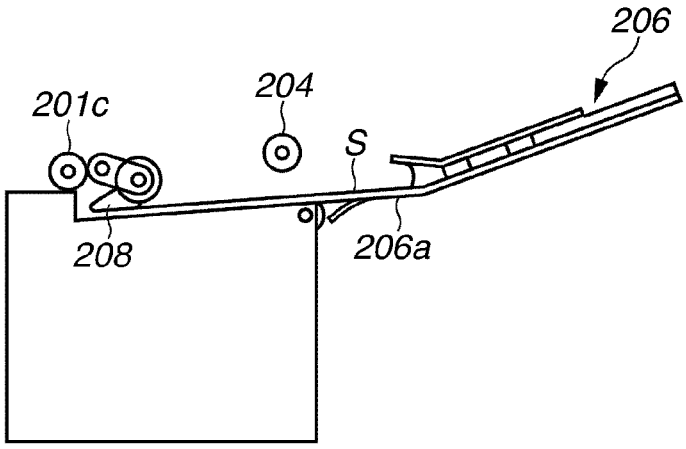

In this way, after the sheet S is conveyed by the conveyance roller 201*c*, the conveyed sheet S is placed while the bottom surface thereof is supported by the intermediate stacking portion 203 and the supporting portions 206*a* and 207*a* of the rear- and front-side alignment portions 206 and 207. As illustrated in FIG. 4B, the sheet S is supported by the intermediate stacking portion 203 and the pair of rear- and front-side alignment portions 206 and 207 so that the sheet S has an approximately planar shape while the center portion thereof in the width direction is prevented from sagging downwards.

Next, to align the sheet S in the width direction, the rear-side alignment portion 206 and the intermediate-stacking-portion side alignment portion 208 are driven by the drive motor 477 toward the center of the sheet S in the width direction as illustrated in an arrow in FIG. 4A. The first pressing member 211 of the rear-side alignment portion 206 and a surface of the intermediate-stacking-portion side alignment portion 208 that comes into contact with a side edge of the sheet are formed to be in the same plane. Thus, the sheet S is moved as two points of the side edge thereof are pressed by the rear-side alignment portion 206 and the intermediate-stacking-portion side alignment portion 208.

Next, as the side edge of the sheet S is pressed, the sheet S is moved and pressed against the alignment reference wall 207*d* of the front-side alignment portion 207 and the side-edge-alignment reference wall 215. As a result, the position of the sheet S in the width direction is aligned. The first pressing member 211 is arranged downstream of the gravity center G of the A4-size sheet in the sheet conveyance direction. The trailing edge of the A4-size sheet is in contact with the trailing-edge-alignment reference wall 216. The intermediate-stacking-portion side alignment portion 208 is arranged near the upstream edge of the A4-size sheet S in the sheet conveyance direction, and the first pressing member 211 is arranged near the downstream edge of the A4-size sheet S in the sheet conveyance direction. In this way, the sheet S can be moved without being rotated.

Figure 5:
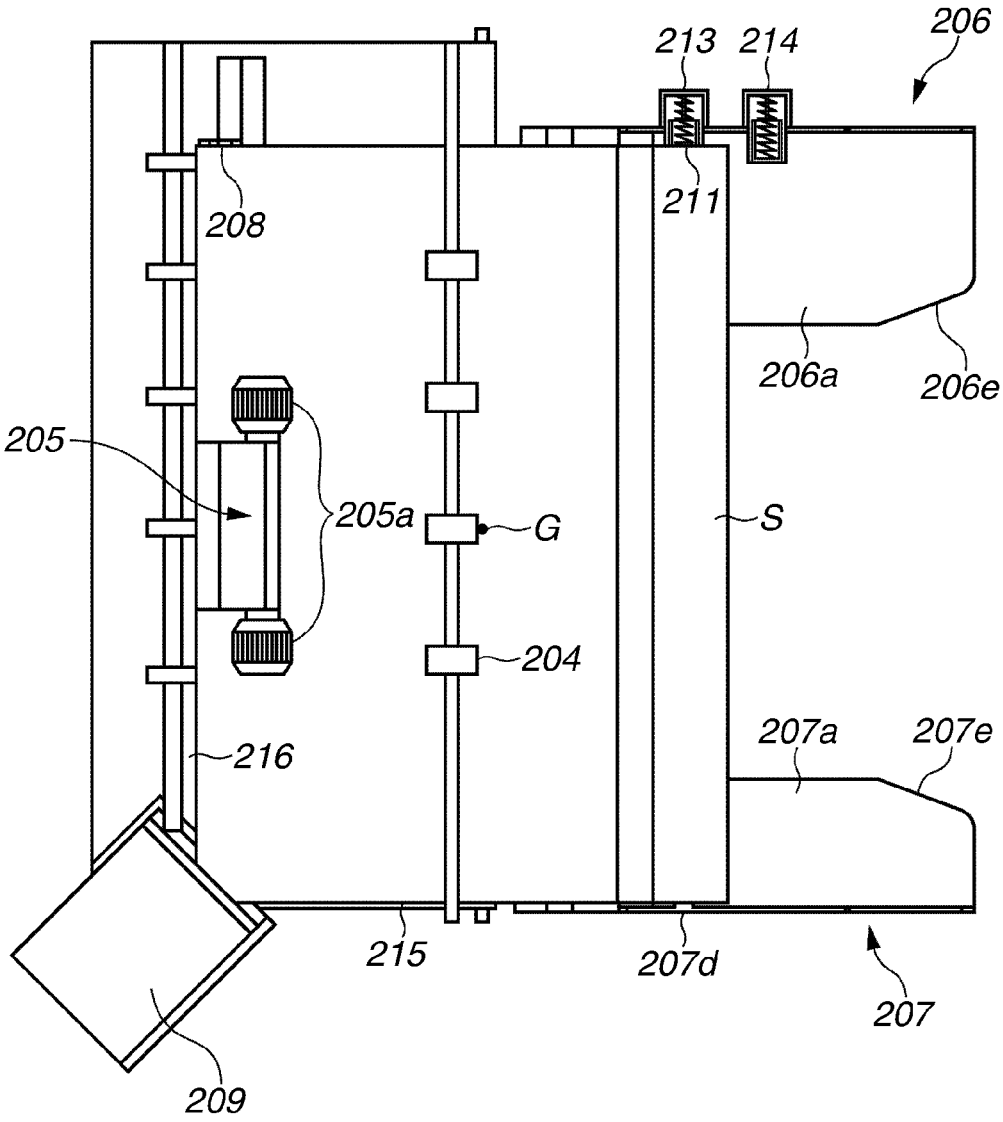
FIG. 5 illustrates the sheet processing apparatus that has aligned the A4-size sheet.

FIG. 5 illustrates a positional relationship of various components when the A4-size sheet S has been aligned in the width direction. During the alignment operation, the rear-side alignment portion 206 is moved until the distance between the pressing plane formed by the first pressing member 211 and the intermediate-stacking-portion side alignment portion 208, and the plane formed by the alignment reference wall 207*d* of the front-side alignment portion 207 and the side-edge-alignment reference wall 215 becomes shorter than the width of the sheet S. Namely, when a sheet is aligned in the width direction, the alignment position of the rear-side alignment portion 206 is within the width of the sheet S.

By setting the alignment position of the rear-side alignment portion 206 in this way, even when the apparent sheet width is decreased by tolerance of a part or the sheet width or curling, the side edge of the sheet S can be surely brought into contact with the front-side alignment portion 207 and the side-edge-alignment reference wall 215. As a result, a stack of sheets can be aligned highly accurately.

The elastic force of the elastic member 213 is set so that, when the first pressing member 211 is pressed by the sheet S after the sheet S comes into contact with the front-side alignment portion 207 and the side-edge-alignment reference wall 215, the first pressing member 211 can move in the direction opposite to the center of the sheet in the width direction.

In addition, as will be described below, the elastic force of the elastic member 214 is set so that, when an A3-size sheet is aligned and the second pressing member 212 is pressed by the sheet, the second pressing member 212 can move in the direction opposite to the center of the sheet in the width direction. Thus, by setting the alignment position of the rear-side alignment portion 206 in this way, the sheet S can be aligned in the width direction, without being damaged.

Next, after the sheet S is aligned in the width direction in this way, the rubber rollers 205*a* of the conveyance-direction alignment portion 205 are moved from the above retracted position to the contact position and are rotated (clockwise direction in FIG. 1) to move the sheet S toward the trailing-edge-alignment reference wall 216. In this way, the trailing edge of the sheet S is aligned. Next, after the trailing edge of the sheet S is aligned in this way and before the next sheet reaches the sheet processing apparatus 200, the rubber rollers 205*a* are moved to the retracted position where the rubber rollers 205*a* do not hinder the sheet conveyance.

Before the next sheet reaches the sheet processing apparatus 200, the rear-side alignment portion 206 is also retracted from the alignment position illustrated in FIG. 5 to the sheet reception position illustrated in FIG. 4A. As in the first exemplary embodiment, when the trailing edge of the sheet S is aligned, if the sheet S is supported by raising the sheet-conveyance-direction downstream side of the sheet S higher than the sheet-conveyance-direction upstream side of the sheet S, the sheet S is affected in the alignment direction by the self-weight. Thus, in the first exemplary embodiment, for example, as illustrated in FIG. 4B, the rear- and front-side alignment portions 206 and 207 are inclined so that the sheet-conveyance-direction downstream side of each of the portions 206 and 207 is raised higher than the sheet-conveyance-direction upstream side.

In addition, in the first exemplary embodiment, a holding member (not illustrated) for pressing aligned sheets from above is arranged near the side-edge-alignment reference wall 215 to move vertically Since this holding member presses the aligned sheets, even when the next sheet is conveyed, the aligned sheets are not misaligned by the next sheet. When the next sheet is aligned, the holding member is retracted to a position where the holding member does not hinder the next sheet alignment operation. When the next sheet alignment operation is completed, the holding member is lowered to press the next sheet. Each time a sheet is discharged from the conveyance roller 201*c* onto the sheets supported by the intermediate stacking portion 203 and the supporting portions 206*a* and 207*a* of the rear- and front-side alignment portions 206 and 207, the above alignment process in the width and conveyance directions is executed. The above alignment process in the width and conveyance directions is repeatedly executed for each discharged sheet, until the sheet processing apparatus 200 completes processing a job of a predetermined number of sheets.

Next, when the alignment process is completed for the predetermined number of sheets, the stapler 209 serving as a binding processing portion staples the sheet stack, and the discharge roller pair 204, which has been separated from the sheet stack nips the sheet stack and rotates. Accordingly, the sheet stack is conveyed in the sheet conveyance direction. Next, by causing the rear- and front-side alignment portions 206 and 207 to move in the direction opposite to the center of the sheet in the width direction, the sheet stack is dropped and loaded onto the sheet discharge tray 210.

Figure 6A:
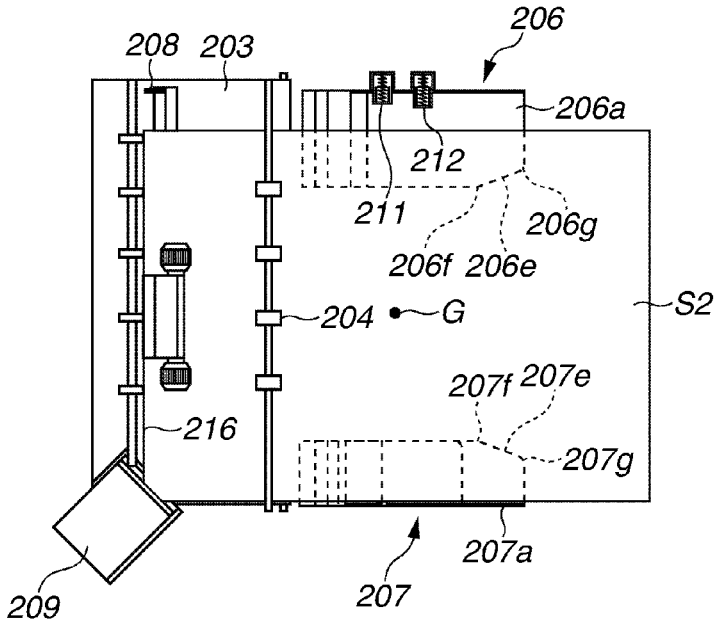
FIGS. 6A to 6C illustrate the sheet processing apparatus that has aligned an A3-size sheet.

Next, a sheet processing operation of the sheet processing apparatus 200 executed to align an A3-size sheet S2 will be described. In this operation, the alignment process in the width direction and the trailing-edge alignment process for an A3-size sheet S2 are the same as those for an A4-size sheet S2. Thus, redundant description thereof will be avoided. After the alignment process in the width direction and the trailing-edge alignment process are completed for an A3-size sheet and before the next sheet is conveyed, the rear-side alignment portion 206 is retracted to the sheet reception position from the alignment position, as illustrated in FIG. 6A.

Figure 6B:
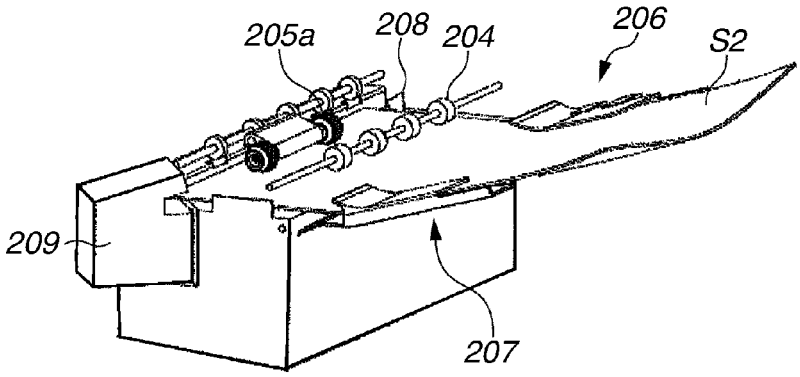
Figure 6C:
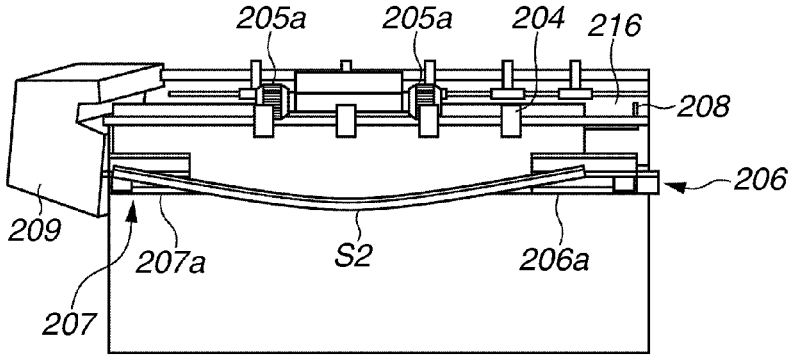

After the rear-side alignment portion 206 is retracted to the sheet reception position in this way, as illustrated in FIGS. 6B and 6C, the supporting portions 206*a* and 207*a* support both edges of the conveyed A3-size sheet S2 in the sheet conveyance direction. The downstream portion includes the gravity center G of the sheet S2. As a result, the sheet S2 is held in such a shape that the center portion in the width direction sags downwards and both the edges are raised (hereinafter, this shape will be referred to as a gutter shape). In the case of an A4-size sheet, since the center of gravity G of the sheet S is positioned on the intermediate stacking portion 203 as illustrated in FIG. 4, the center portion of the sheet S in the width direction rarely sags downwards.

If the sheet S2 is held in the gutter shape, since rigidity (hereinafter referred to as stiffness) in the sheet conveyance direction is increased, the sheet-conveyance-direction downstream portion of the sheet S2 does not sag downwards by the stiffness of the sheet S2. As described above, the supporting portions 206*a* and 207*a* of the rear- and front-side alignment portions 206 and 207 support the downstream portion of the sheet S2 in the sheet conveyance direction, including the center of gravity G of the sheet S2. Since the sheet S2 is held in the gutter shape, even if the supporting portions 206*a* and 207*a* have a smaller area for supporting both edges of the sheet, the posture of the sheet S2 can be maintained while the downstream portion thereof is raised. However, on the sheet-conveyance-direction upstream side where the trailing-edge-alignment reference wall 216 and the stapler 209 are arranged, it is desirable that the sheet S2 be held in a planar shape.

If the sheet-conveyance-direction downstream portion of the sheet S2 is held in the gutter shape as described above, the apparent sheet width of the downstream portion of the sheet S2 is decreased to be less than the prescribed value of the sheet S2. In addition, as described above, when the sheet S2 is aligned in the width direction, to prevent rotation of the sheet S2, it is desirable that side edges of the sheet S2 be pressed upstream and downstream of the center of gravity G of the sheet S2 in the sheet conveyance direction.

Thus, in the first exemplary embodiment, as illustrated in FIG. 3B, the rear-side alignment portion 206 includes the first and second pressing members 211 and 212 for A4- and A3-size sheets, respectively, and the second pressing member 212 is formed to protrude further toward the sheet center in the width direction than the first pressing member 211. Namely, the second pressing member 212 is arranged to jut out from the vertical portion 206*c* more than the first pressing member 211.

It is desirable that the protrusion amount of the second pressing member 212 be set larger than the reduction amount of the apparent sheet width caused by holding the sheet in the gutter shape. In the first exemplary embodiment, the protrusion amount of the second pressing member 212 is set larger than the reduction amount of the apparent sheet width caused by holding the sheet in the gutter shape. Thus, by forming the second pressing member 212 to protrude in such a protrusion amount, the second pressing member 212 can be brought into contact with a sheet side edge earlier than the first pressing member 211. Namely, the sheet side edge can be pressed upstream and downstream of the center of gravity G of the sheet S2 in the sheet conveyance direction.

As a result, when the sheet S2 is aligned in the width direction, rotation of the sheet S2 can be prevented. Even if the sheet S2 is rotated by the second pressing member 212, the trailing edge of the sheet is moved toward the trailing-edge-alignment reference wall 216 as the sheet S2 is rotated, that is, in the clockwise direction in FIG. 6A. Thus, alignment of the sheet stack is little affected.

In the first exemplary embodiment, the sheet S2 is held by causing the downstream center portion thereof to sag in the gutter shape. Thus, as illustrated in FIG. 3A, a cut portion 207*e* is formed at a downstream end corner of the supporting portion 207*a* of the front-side alignment portion 207 on the sheet center side in the width direction. In addition, as illustrated in FIG. 3B, a cut portion 206*e* is formed at a downstream end corner of the support portion 206*a* of the rear-side alignment portion 206 on the sheet center side in the width direction. The cut portion 206*e* has a linearly-cut chamfered shape.

By forming these cut portions 206*e* and 207*e* at the downstream ends of the supporting portions 206*a* and 207*a* of the rear- and front-side alignment portions 206 and 207 on the sheet center side in the width direction, the center portion of the sheet S2 in the width direction can easily sag between the cut portions 206*e* and 207*e*. In addition, in the first exemplary embodiment, these cut portions 206*e* and 207*e* are shaped so that the supporting portions 206*a* and 207*a* taper to the respective narrower downward ends. Namely, the supporting portions 206*a* and 207*a* of the rear- and front-side alignment portions 206 and 207 have a reduced sheet supporting area at the respective downstream ends, and accordingly, as moving to the downstream side, the sheet S2 gradually changes the shape from the approximately planar shape to the gutter shape.

If such cut portions 206*e* and 207*e* are formed, the sheet S2 is held while being into contact with a ridge line between corner portions 207*f* and 207*g* of the cut portion 207*e* and a ridge line between corner portions 206*f* and 206*g* of the cut portion 206*e*, as illustrated in FIG. 6C. As a result, the gutter shape is formed. In addition, there are cases where the sheet processing apparatus 200 processes a long sheet such as an A3 sheet, whose sheet-conveyance-direction downstream edge is located downstream of the downstream ends of the rear- and front-side alignment portions 206 and 207 in the sheet conveyance direction. In such cases, it is desirable that the corner portions 206*g* and 207*g* always be located inside both edges of the sheet in the width direction.

In other words, it is desirable that the intersection between the sheet-conveyance-direction downstream end of the support portion 206*a* of the rear-side alignment portion 206 and the ridge line of the cut portion always be located closer to the sheet center in the width direction than the corresponding edge of the supported sheet. The same applies to the other side. By forming the corner portions 206*g* and 207*g* at such positions as the intersections, it becomes possible to prevent the sheet placement position from changing when a sheet side edge moves over the corner portion 206*g* or 207*g*. Namely, the sheet shape can be stably held.

However, it is not desirable that the second pressing member 212 be formed excessively downstream in the sheet conveyance direction. This is because, since the sheet has the gutter shape, when the second pressing member 212 presses the side edge of the sheet during an alignment process, the pressing force may not be sufficiently applied to the sheet. As a result, the sheet may not be moved. Thus, in the first exemplary embodiment, the second pressing member 212 is formed between a position slightly downstream of the leading edge of an A4-size sheet and a position near the cut portion 206*e* of the support portion 206*a* at which the sheet starts forming the gutter shape.

As described above, in the first exemplary embodiment, the cut portions 206*e* and 207*e* are formed on the supporting portions 206*a* and 207*a* of the rear- and front-side alignment portions 206 and 207, respectively. In this way, the center of the sheet-conveyance-direction downstream portion of the sheet sags downwards. In addition, the second pressing member 212 is formed to protrude toward the center of the sheet in the width direction than the first pressing member 211. In this way, the second pressing member 212 can come into contact with the side edge of the sheet-conveyance-direction downstream portion of the sheet whose center portion sags downwards in the width direction.

In this way, the sheet can be stably aligned and processed. In addition, according to the first exemplary embodiment, even when a large-size sheet is aligned, since there is no need to support the entire bottom surface of the sheet, the size of each of the alignment portions 206 and 207 does not need to be increased. Thus, a sheet stack can be aligned highly accurately at low cost. In addition, since the size of each of the alignment portions 206 and 207 can be reduced, more space for a user to reach for sheets loaded on the sheet discharge tray 210 can be created. In this way, for example, sheets can be extracted more easily, and loaded sheets can be viewed more clearly. Namely, usability is improved.

Figure 7A:
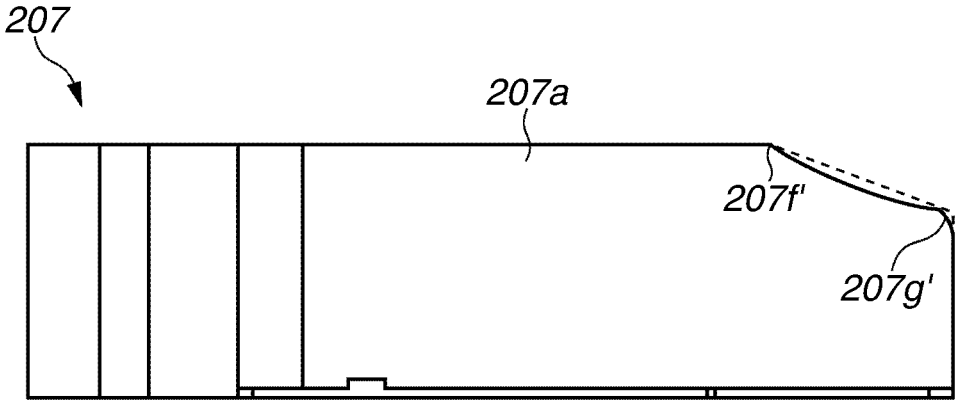
FIGS. 7A and 7B illustrate other shapes of cut portions formed on supporting portions of the front- and rear-side alignment portions.
Figure 7B:
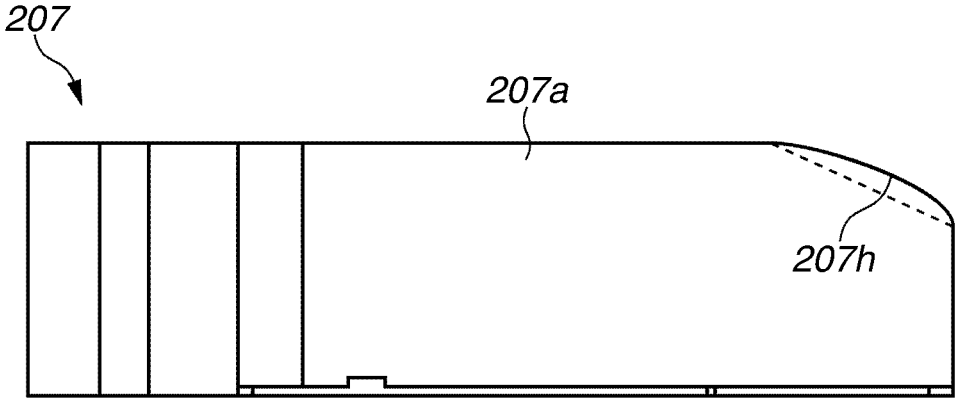

Other than the linearly-cut chamfered shape as illustrated in FIG. 3A, the cut portion 207*e* may have a curved shape as illustrated in FIG. 7A. In this way, since the cut portion 207*e* is depressed toward the alignment reference wall 207*d*, the support surface of the supporting portion 207*a* is decreased. By shaping the cut portion 207*e* in this way, points of contact 207*f*' and 207*g*' between the sheet and the supporting portion 207*a* of the front-side alignment portion 207 are less affected by stiffness of the sheet. Thus, the sheet can stably be formed to have the gutter shape. In contrast, if the cut portion 207*e* is jutted as illustrated in FIG. 7B instead of having the linearly-cut shape, a point of contact 207*h* is more affected by stiffness of the sheet. More specifically, since the sheet and the supporting portion 207*a* are in contact with each other only at one contact point 207*h*, the sheet and the supporting portion 207*a* are not stabilized. In addition, the sheet supporting posture is not stabilized, either.

While the sheet processing apparatus for processing sheets of various sizes such as A4- and A3-size sheets has thus been described, the present invention is not limited to such sheet processing apparatus. The present invention is applicable to a sheet processing apparatus for processing sheets of other sizes such as LTR and LDR-size sheets. In this case, a plurality of second pressing members 212 is arranged in the sheet conveyance direction, and when a sheet of a different size is processed, a second pressing member 212 arranged at a position corresponding to the sheet size presses a side of the sheet-conveyance-direction downstream portion of the sheet.

Figure 8A:
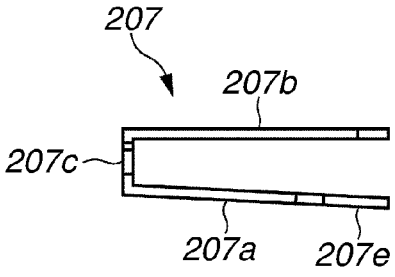
FIGS. 8A and 8B illustrate configurations of front- and rear-side alignment portions of a sheet processing apparatus according to a second exemplary embodiment of the present invention, respectively.
Figure 8B:
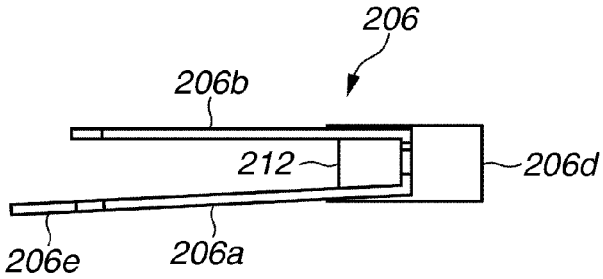

Next, a second exemplary embodiment of the present invention will be described. FIG. 8 illustrates configurations of the rear- and front-side alignment portions 206 and 207 of a sheet processing apparatus according to the second exemplary embodiment. In FIG. 8, reference characters identical to those in FIG. 2 denote identical or corresponding portions.

In the second exemplary embodiment, the supporting portions 206*a* and 207*a* of the rear- and front-side alignment portions 206 and 207 are not formed horizontally. Each of the supporting portions 206*a* and 207*a* is inclined downwards from the width-direction outer end toward the center of the sheet. By inclining these supporting portions 206*a* and 207*a* in this way, the downstream portion of the sheet can be more easily held in the gutter shape.

In the second exemplary embodiment, the width of the sheet supporting space at both the width-direction ends of each of the rear- and front-side alignment portions 206 and 207 is not changed. Namely, the distance between the support portion 206*a* and the upper restriction portion 206*b* and the distance between the supporting portion 207*a* and the upper restriction portion 207*b* are not changed. In this way, when a curled sheet is aligned at both of the ends, the upper restriction portions 206*b* and 207*b* can prevent curling at both of the ends of the sheet.

Figure 9:
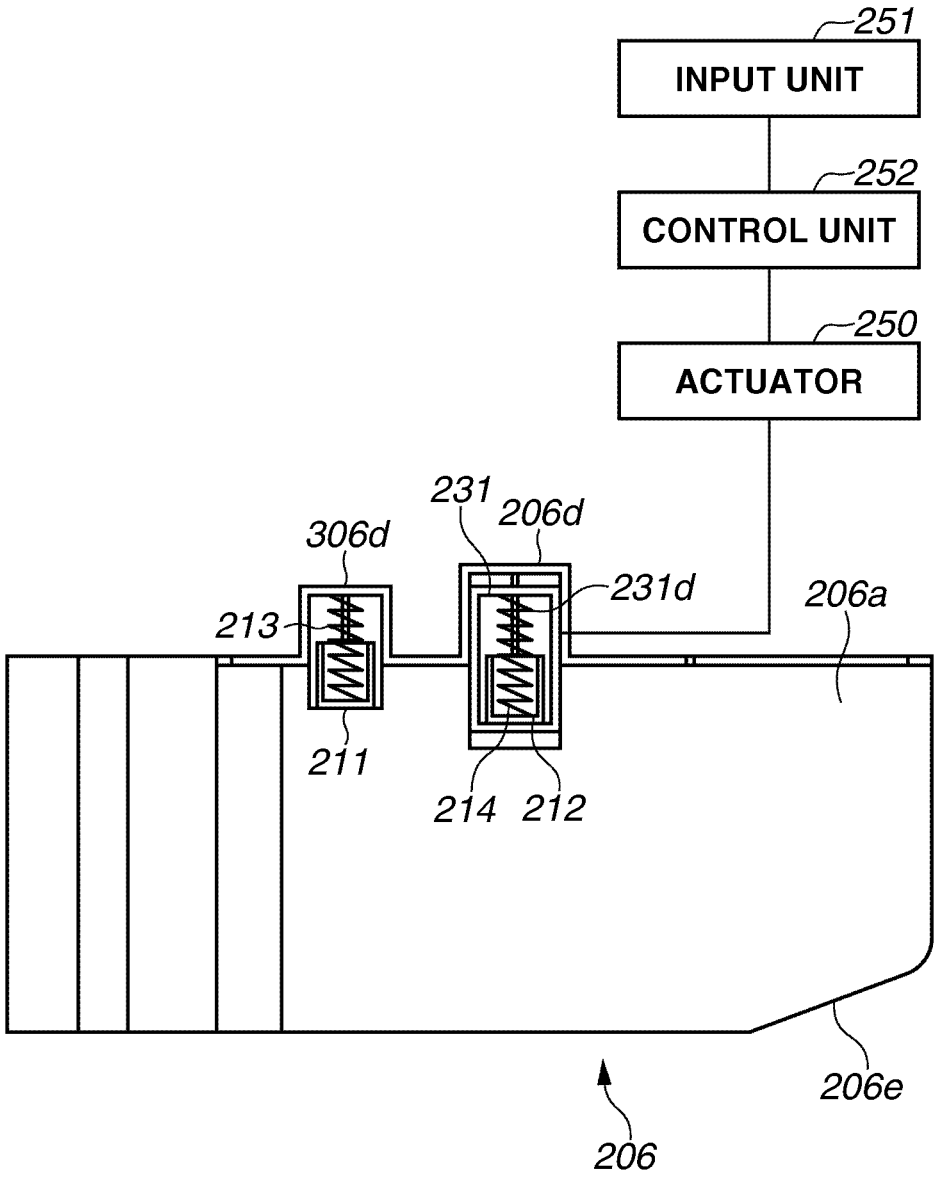
FIG. 9 illustrates a configuration of a rear-side alignment portion of a sheet processing apparatus according to a third exemplary embodiment of the present invention.

Next, a third exemplary embodiment of the present invention will be described. FIG. 9 illustrates a configuration of the rear-side alignment portion 206 of a sheet processing apparatus according to the third exemplary embodiment. In FIG. 9, reference characters identical to those in FIG. 3 denote identical or corresponding portions.

In FIG. 9, the rear-side alignment portion 206 includes a pressing member holder 231 for holding the second pressing member 212 and the elastic member 214, which are attached movably in the width direction along a guiding portion 231*d* provided with the pressing member holder 231. In addition, this pressing member holder 231 is attached so that the pressing member holder 231 can be moved by an actuator 250 in the width direction along the guiding portion 206*d* formed on the rear-side alignment portion 206.

In addition, the third exemplary embodiment includes an input unit 251 for inputting information about sheet rigidity, such as sheet thickness or grammage, to the apparatus body 100 or the sheet processing apparatus 200. In addition, the third exemplary embodiment includes a control unit 252 for controlling the actuator 250 based on the information about sheet rigidity supplied from the input unit 251. The control unit 252 controls the position of the pressing member holder 231, in other words, the protrusion amount of the pressing member holder 231 in the width direction. Namely, in the third exemplary embodiment, by moving the pressing member holder 231 in the width direction based on the sheet information obtained by the input unit 251, the protrusion amount of the second pressing member 212 is changed.

For example, if the control unit 252 determines that a conveyed sheet is a thin sheet having low stiffness based on the sheet information supplied from the input unit 251 such as a sensor or an operation unit, the control unit 252 predicts that the downstream portion of the sheet will have a larger gutter shape and the apparent sheet width will be shorter. In such case, the control unit 252 moves the second pressing member 212 toward the sheet center in the width direction, to increase the protrusion amount of the second pressing member 212 to be greater than that of the first pressing member 211.

In contrast, if a thick sheet is conveyed, the protrusion amount can be decreased. Since the second pressing member 212 is moved based on the sheet thickness/grammage so that the protrusion amount of the second pressing member 212 becomes a predetermined amount with respect to the first pressing member 211, a sheet of an arbitrary thickness/grammage can be accurately aligned. Namely, by changing the protrusion amount of the first pressing member 211 based on the sheet thickness/grammage, a sheet of an arbitrary thickness/grammage can be accurately aligned.

Figure 10A:
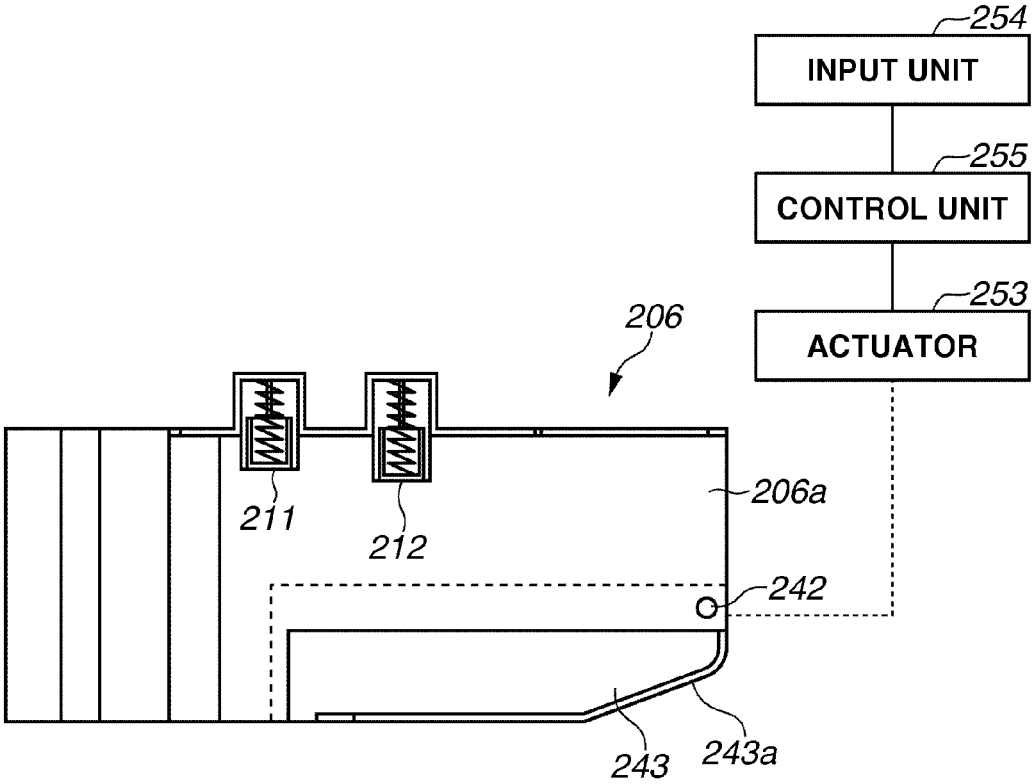
FIGS. 10A and 10B illustrate a configuration of a rear-side alignment portion of a sheet processing apparatus according to a fourth exemplary embodiment of the present invention.
Figure 10B:
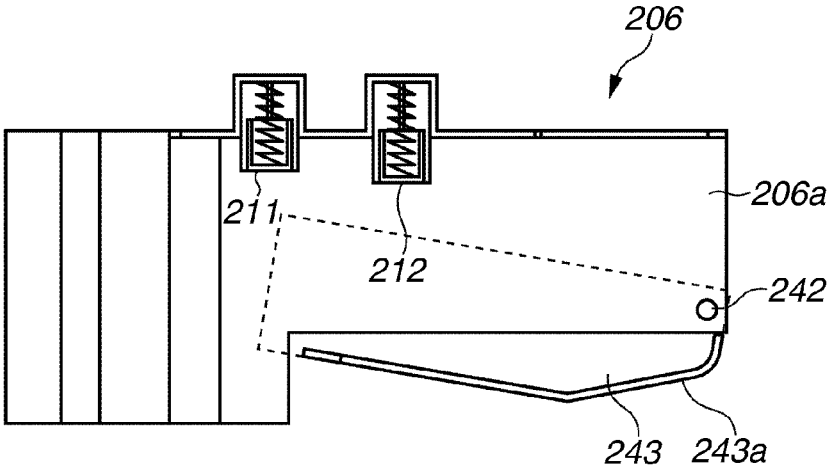

Next, a fourth exemplary embodiment of the present invention will be described. FIG. 10 illustrates a configuration of the rear-side alignment portion 206 of a sheet processing apparatus according to the fourth exemplary embodiment. In FIG. 10, reference characters identical to those in FIG. 3 denote identical or corresponding portions.

In FIG. 10, a rotatable support portion 243 is rotatably arranged at the support portion 206*a* of the rear-side alignment portion 206. The rotatable support portion 243 is rotated around a point of rotation 242 by an actuator 253. The rear-side alignment portion 206 uses the support portion 206*a* and the rotatable support portion 243 to support the sheet-conveyance-direction downstream edge of the sheet. In addition, the fourth exemplary embodiment includes: an input unit 254 for inputting information about sheet rigidity; and a control unit 255 controlling the actuator 253 and rotating the rotatable support portion 243 based on the information about sheet rigidity supplied from the input unit 254. While not illustrated, the front-side alignment portion 207 has a similar configuration.

In the fourth exemplary embodiment, the rotatable support portion 243 has a cut portion 243*a* at the sheet-center-side corner of the sheet-conveyance-direction downstream end. If the rotatable support portion 243 having such cut portion is rotated, since the position of the cut portion of the rear-side alignment portion 206 is changed, the sheet supporting area of the rear-side alignment portion 206 is accordingly changed.

Thus, in the fourth exemplary embodiment, before a sheet is conveyed, the rotatable support portion 243 is rotated based on the sheet information obtained by the input unit 254, and the sheet supporting area of the rear-side alignment portion 206 is changed. Namely, in the fourth exemplary embodiment, the rotatable support portion 243 is rotated in an optimum rotation amount based on the sheet thickness/grammage, the position of cut portion is changed, and the sheet supporting area of the rear-side alignment portion 206 is changed. For example, when a thick sheet is aligned, the position of the cut portion is changed so that the supporting area is decreased. When a thin sheet is aligned, the position of cut portion is changed so that the supporting area is increased. In this way, the sheet can always have an optimum gutter shape at the sheet-conveyance-direction downstream portion thereof, and a sheet of an arbitrary thickness/grammage can be aligned highly accurately.

The present invention has been illustrated based on a sheet processing apparatus capable of executing a sheet alignment process and a binding process as sheet processing. However, the present invention is also applicable to an apparatus capable of only a sheet alignment process as sheet processing. In addition, the width-direction alignment unit 200A using the intermediate-stacking-portion side alignment portion 208 and the rear- and front-side alignment portions 206 and 207 that move in the width direction has been described. However, the present invention is not limited to such example. For example, the present invention may be configured so that, when a sheet is aligned, the front-side alignment portion 207 is fixed and the rear-side alignment portion 206 is moved.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-214011 filed Sep. 29, 2011, which is hereby incorporated by reference herein in its entirety.

What is claimed is:

1. A sheet processing apparatus, comprising:

a conveyance portion configured to convey a sheet in a sheet conveyance direction;

a sheet stacking portion configured to stack a sheet conveyed by the conveyance portion;

a sheet supporting portion arranged downstream of the sheet stacking portion in the sheet conveyance direction and configured to support side edges of the sheet in a width direction perpendicular to the sheet conveyance direction; and an alignment unit arranged on one side of the sheet supporting portion in the width direction and configured to align the position of the sheet supported by the sheet supporting portion in the width direction by moving toward a center side in the width direction, wherein the alignment unit comprises:

an upstream-side pressing portion configured to press a side edge of the sheet supported by the sheet supporting portion in the width direction; and a downstream-side pressing portion arranged downstream of the upstream-side pressing portion in the sheet conveyance direction and configured to press the side edge of the sheet supported by the sheet supporting portion, and wherein the downstream-side pressing portion comprises:

a first pressing portion arranged downstream of the center of gravity of a predetermined-size sheet supported by the sheet supporting portion in the sheet conveyance direction and upstream of a downstream edge of the predetermined-size sheet in the sheet conveyance direction and configured to press the predetermined-size sheet; and a second pressing portion arranged downstream of the downstream edge of the predetermined-size sheet supported by the sheet supporting portion in the sheet conveyance direction and downstream of the center of gravity of a large-size sheet having twice or more than twice the length of the predetermined-size sheet and configured to press the large-size sheet, the second pressing portion being formed to protrude further toward the center side in the width direction than the first pressing portion.

2. The sheet processing apparatus according to claim 1, wherein the first and second pressing portions of the downstream-side pressing portion protrude further toward the center side in the width direction than the upstream-side pressing portion.

3. The sheet processing apparatus according to claim 1, wherein the alignment unit movably holds the first and second pressing portions and comprises: a holding portion configured to move in the width direction; a spring arranged between the holding portion and the first pressing portion; and a spring arranged between the holding portion and the second pressing portion, and wherein, when brought into contact with a sheet, the first and second pressing portions are pressed by the sheet and moved toward the holding portion against elastic force of the springs.

4. The sheet processing apparatus according to claim 1, wherein the sheet supporting portion includes a cut portion at a corner downstream in the sheet conveyance direction on the center side in the width direction.

5. The sheet processing apparatus according to claim 4, wherein the cut portion of the sheet supporting portion has a linearly-cut chamfered shape or a curved shape having a more depressed surface than the linearly-cut chamfered shape.

6. The sheet processing apparatus according to claim 1, wherein the sheet supporting portion is inclined downwards from the side ends thereof to the center side thereof in the width direction.

7. The sheet processing apparatus according to claim 4, further comprising:

an actuator capable of changing a protrusion amount of the second pressing portion in the width direction;

an input unit configured to input sheet information; and a control unit configured to control the actuator based on sheet information from the input unit, so that the second pressing portion is moved to come into contact with a sheet-conveyance-direction downstream side edge of a sheet whose width-direction center portion sags downwards.

8. The sheet processing apparatus according to claim 4, further comprising:

an actuator configured to rotate a portion on which the cut portion is formed;

an input unit configured to input sheet information; and a control unit configured to control the actuator based on sheet information from the input unit.

9. An image forming apparatus, comprising:

an image forming portion configured to form an image on a sheet;

a conveyance portion configured to convey a sheet on which an image is formed by the image forming portion, in a sheet conveyance direction;

a sheet stacking portion configured to stack a sheet conveyed by the conveyance portion;

a sheet supporting portion arranged downstream of the sheet stacking portion in the sheet conveyance direction and configured to support side edges of the sheet in a width direction perpendicular to the sheet conveyance direction; and an alignment unit arranged on one side of the sheet supporting portion in the width direction and configured to align the position of the sheet supported by the sheet supporting portion in the width direction by moving toward a center side in the width direction, wherein the alignment unit comprises:

an upstream-side pressing portion configured to press a side edge of the sheet supported by the sheet supporting portion in the width direction; and a downstream-side pressing portion arranged downstream of the upstream-side pressing portion in the sheet conveyance direction and configured to press the side edge of the sheet supported by the sheet supporting portion, and wherein the downstream-side pressing portion comprises:

a first pressing portion arranged downstream of the center of gravity of a predetermined-size sheet supported by the sheet supporting portion in the sheet conveyance direction and upstream of a downstream edge of the predetermined-size sheet in the sheet conveyance direction and configured to press the predetermined-size sheet; and a second pressing portion arranged downstream of the downstream edge of the predetermined-size sheet supported by the sheet supporting portion in the sheet conveyance direction and downstream of the center of gravity of a large-size sheet having twice or more than twice the length of the predetermined-size sheet and configured to press the large-size sheet, the second pressing portion being formed to protrude further toward the center side in the width direction than the first pressing portion.

10. The image forming apparatus according to claim 9, wherein the first and second pressing portions of the downstream-side pressing portion protrude further toward the center side in the width direction than the upstream-side pressing portion.

11. The image forming apparatus according to claim 9, wherein the alignment unit movably holds the first and second pressing portions and comprises: a holding portion configured to move in the width direction; a spring arranged between the holding portion and the first pressing portion; and a spring arranged between the holding portion and the second pressing portion, and wherein, when brought into contact with a sheet, the first and second pressing portions are pressed by the sheet and moved toward the holding portion against elastic force of the springs.

12. The image forming apparatus according to claim 9, wherein the sheet supporting portion includes a cut portion at a corner downstream in the sheet conveyance direction on the center side in the width direction.

13. The image forming apparatus according to claim 12, wherein the cut portion of the sheet supporting portion has a linearly-cut chamfered shape or a curved shape having a more depressed surface than the linearly-cut chamfered shape.

14. The image forming apparatus according to claim 9, wherein the sheet supporting portion is inclined downwards from the side ends thereof to the center side thereof in the width direction.

15. The image forming apparatus according to claim 12, further comprising:

an actuator capable of changing a protrusion amount of the second pressing portion in the width direction;

an input unit configured to input sheet information; and a control unit configured to control the actuator based on sheet information from the input unit, so that the second pressing portion is moved to come into contact with a sheet-conveyance-direction downstream side edge of a sheet whose width-direction center portion sags downwards.

16. The image forming apparatus according to claim 12, further comprising:

an actuator configured to rotate a portion on which the cut portion is formed;

an input unit configured to input sheet information; and a control unit configured to control the actuator based on sheet information from the input unit.

* * * * *